US012171349B2

(12) United States Patent
Roaks

(10) Patent No.: US 12,171,349 B2
(45) Date of Patent: Dec. 24, 2024

(54) CONTAINER CLOSURE, LID ELEMENT FOR USE IN THE CONTAINER CLOSURE, AND CONTAINER ARRANGEMENT

(71) Applicant: Twistshake of Sweden AB, Västerås (SE)

(72) Inventor: Vienar Roaks, Västerås (SE)

(73) Assignee: TWISTSHAKE OF SWEDEN AB, Västerås (SE)

( * ) Notice: Subject to any disclaimer, the term of this patent is extended or adjusted under 35 U.S.C. 154(b) by 24 days.

(21) Appl. No.: 18/107,657

(22) Filed: Feb. 9, 2023

(65) Prior Publication Data

US 2023/0255377 A1 Aug. 17, 2023

(30) Foreign Application Priority Data

Feb. 11, 2022 (EP) ..... 22156338

(51) Int. Cl.
*A47G 19/22* (2006.01)

(52) U.S. Cl.
CPC ..... *A47G 19/2272* (2013.01)

(58) Field of Classification Search
CPC ..... A47G 19/2266; A47G 19/2272; A47G 19/2211; A47G 19/2216; B65D 39/16; B65D 51/242
USPC ..... 206/212.5
See application file for complete search history.

(56) References Cited

U.S. PATENT DOCUMENTS

| | | | | |
|---|---|---|---|---|
| 2015/0096985 | A1* | 4/2015 | Bargiel | A47G 19/30 220/203.19 |
| 2018/0008069 | A1* | 1/2018 | Beltrami | A47G 19/2272 |
| 2020/0154916 | A1 | 5/2020 | Cudworth et al. | |
| 2020/0383505 | A1 | 12/2020 | Rees | |

FOREIGN PATENT DOCUMENTS

| | | | | |
|---|---|---|---|---|
| EP | 3266352 | A1 * | 1/2018 | A47G 19/2272 |
| EP | 3698677 | A1 * | 8/2020 | |
| WO | WO-2019102210 | A1 * | 5/2019 | A47G 19/2272 |
| WO | WO-2019110052 | A1 * | 6/2019 | A47G 19/2272 |
| WO | 2021237278 | A1 | 12/2021 | |

OTHER PUBLICATIONS

European Search Report for European Patent Application No. 22156338.0, dated Jul. 26, 2022.

* cited by examiner

*Primary Examiner* — Rafael A Ortiz
(74) *Attorney, Agent, or Firm* — Patterson + Sheridan, LLP

(57) ABSTRACT

A ring chamber (11) is formed between the ring element (2) and the lid element (1). Through the channels (6) the ring chamber (11) is in fluid communication with the inside of the container (3). The upper circumferential rim (12) forms a sealing surface matching a corresponding surface of the sealing lip (5) and cooperates therewith to form a sealing contact between the ring element (2) and the lid element (1). The ring element (2) is essentially rigid whereas the lid element (1) including the sealing lip (5) is substantially flexible. Accordingly, in a sealing configuration, the ring chamber (11) is sealed towards the outside. By deforming the sealing lip (5) the sealing contact is interrupted and liquid can be drunk. The deformation is reversible re-establishing the sealing configuration by the restoring force of the deformed lid element (1)/sealing lip (5), when deforming forces are sufficiently reduced.

14 Claims, 3 Drawing Sheets

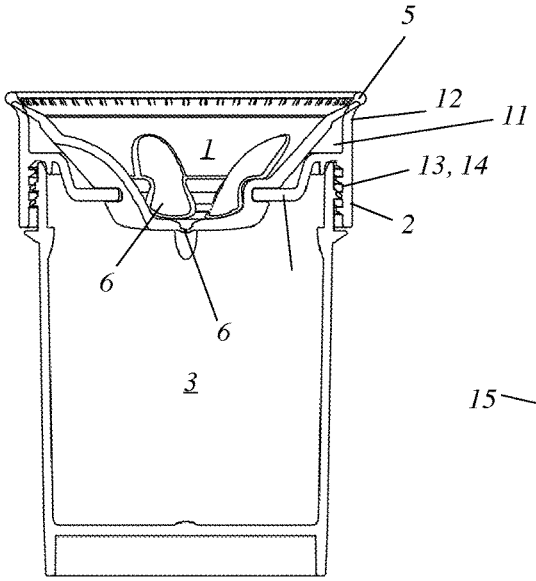
Fig. 2b
Fig. 2a
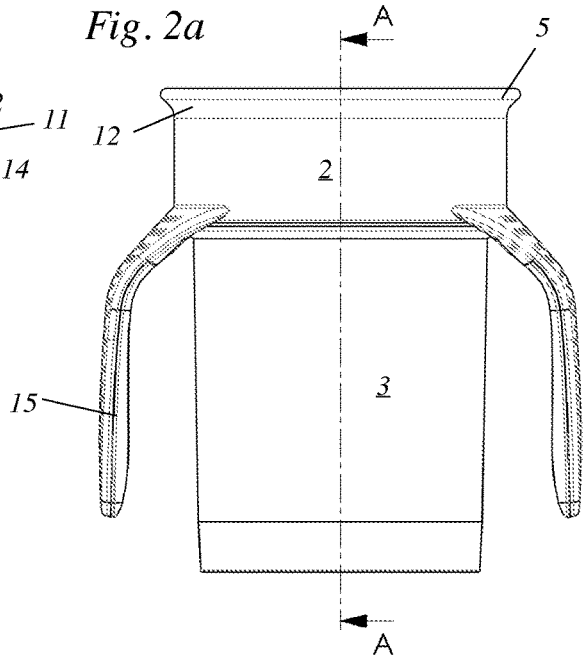
Fig. 2d
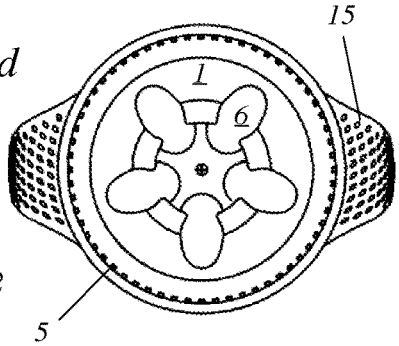
Fig. 2f
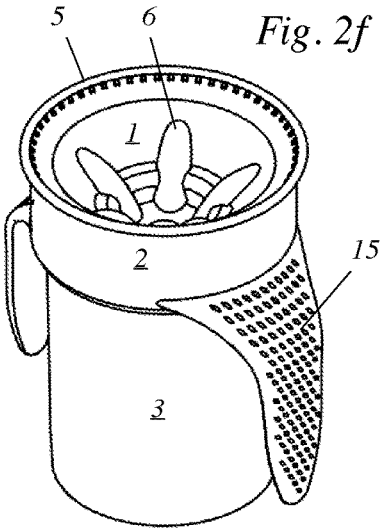
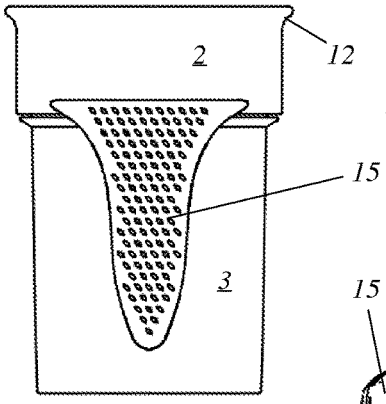
Fig. 2c
Fig. 2e
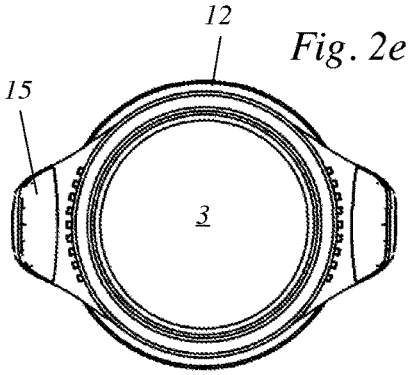

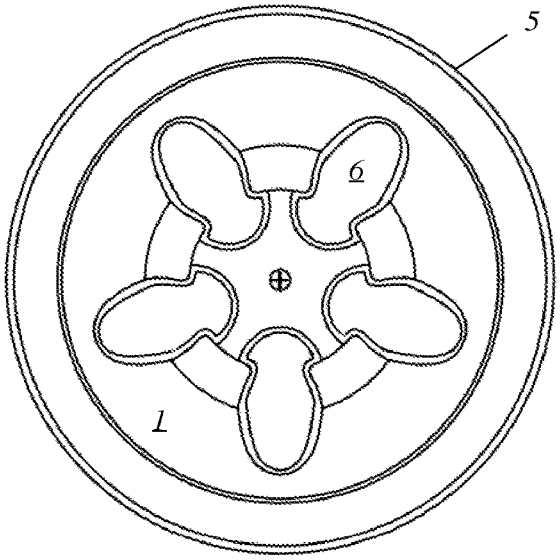
Fig. 3d
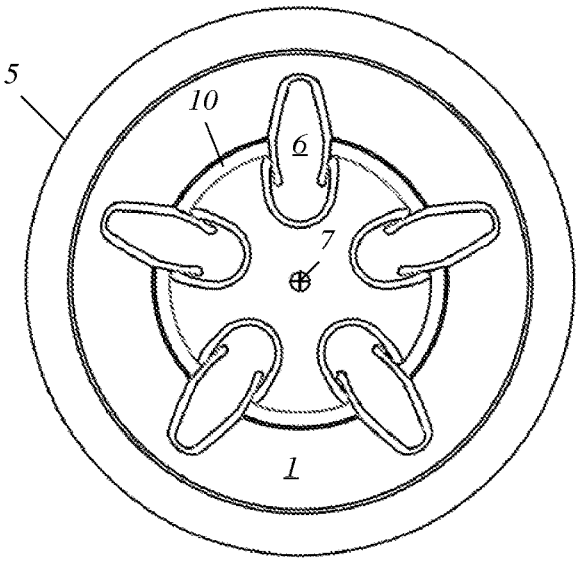
Fig. 3e
Fig. 3a
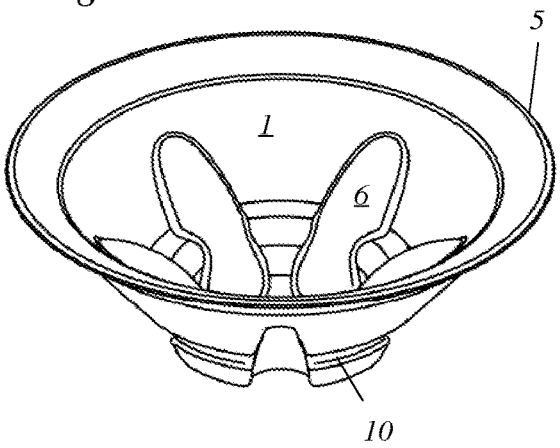
Fig. 3b
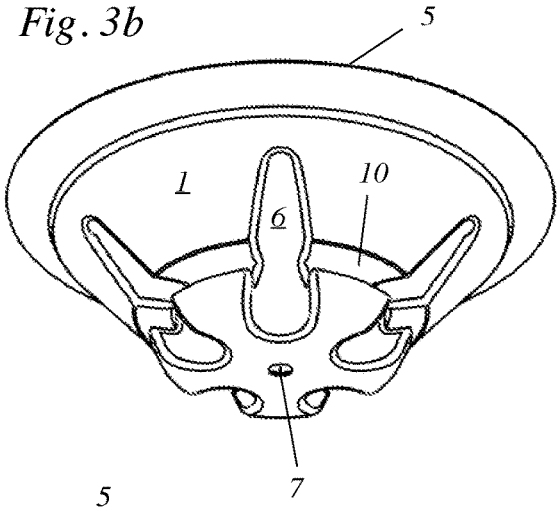
Fig. 3c
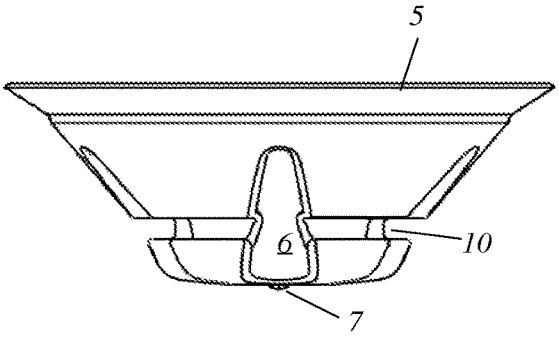

CONTAINER CLOSURE, LID ELEMENT FOR USE IN THE CONTAINER CLOSURE, AND CONTAINER ARRANGEMENT

CROSS-REFERENCE TO RELATED APPLICATIONS

This application claims priority to European Patent Application No. 22156338.0, filed Feb. 11, 2022, the entire contents of which are incorporated herein by reference.

BACKGROUND

The present invention relates to the field of container closures, in particular closures of drinking bottles and drinking cups, in particular for toddlers and people impaired with regard to their motor function, e.g. elderly people, Parkinson patients etc., when there is an increased risk of spilling liquid contents from the container. Further, the present invention relates to a lid element for use in a container closure, and to a container arrangement comprising a container closure.

Open cups or drinking bottles are not entirely suitable for toddlers and some people having conditions making them more likely to spill liquid contents from the cups or containers, for example due to shaking or due to limited abilities to fully or accurately control the movements of their hands or arms. Therein, spilling may either occur during the course of drinking or while moving the container towards or from the mouth, or there may be a danger of inadvertently knocking over the container while it is standing on a surface. The latter may occur not only due to insufficient control over a person's own movements but also due to poor eyesight, for example. Toddlers in particular may have problems to control the tilting angle of a container while drinking therefrom, thus causing liquid running down their faces next to their mouths. Further, there may also be a danger of spilling liquid contents of a container depending on the situation, even if the user has no physiological issues, for example due to inertial forces in a moving vehicle or during physical activities such as long distance running.

In order to avoid spilling from cups or drinking bottles they can be protected by a lid or closure. Therein, it is often not practical to have to remove the lid or closure entirely for drinking. On the one hand, a lid or closure removed from the container cannot help to prevent spilling during the course of drinking therefrom. On the other hand, people having motor restrictions increasing the risk of spilling often have difficulties, due to the very same restrictions, to remove lids or closures from drinking containers or reclosing the containers properly.

In view of the above, numerous types of closures for drinking containers are known in the prior art which allow a user to drink from a container without having to remove the closure therefrom entirely. Among such devices conventionally known are teats of baby bottles or the covers of sippy cups or feeding cups. Further, straws or tubes may be used.

Conventionally known closures generally have certain limitations. While a sippy cup may prevent spilling due to shaking or due to poor control of the tilting angle of the cup, it provides only poor protection against liquid leaking through the drinking aperture after the cup has been inadvertently knocked over. Further, the orientation of the cup with respect to the position of the drinking aperture needs to be correct in order to allow proper drinking from a feeding cup, i.e. when tilting the feeding cup in order to drink therefrom, the drinking aperture is to be positioned near the lowered part of the rim of the cup.

Tubes or straws may easily kink thereby pinching off the fluid path. Stiff straws bear the risk of injuring the user by poking with the free end.

While baby bottles are suitable for a certain age group, toddlers should start at some point to use containers usable in a manner resembling drinking from a normal cup. Further, bottle teats may tempt toddlers to use their bottles constantly like pacifiers.

In view of the above, it is an object of the present invention to provide an alternative container closure allowing to drink therefrom without having to remove the closure completely and at the same time reducing at least some of the shortcomings encountered in connection with prior art closures.

SUMMARY

In order to achieve the above object, according to one aspect of the present invention, there is provided a container closure as defined in claim 1. According to another aspect of the present invention, there is provided a container arrangement as defined in claim 13. According to yet another aspect of the present invention, there is provided a lid element as defined in claim 14.

Advantageous embodiments may be implemented according to any of the dependent claims.

In particular, the present invention provides, according to one aspect thereof, a container closure having a container side and a cover side and comprising a ring element, a tapered lid element and a circumferential sealing lip permanently affixed to or formed integral with the lid element. The ring element comprises a ring aperture and a first circumferential sealing surface. The circumferential sealing lip comprises a second circumferential sealing surface matching the first circumferential sealing surface to form together therewith, in a sealing configuration, a circumferential sealing contact. The tapered lid element is circumferentially connected with and extends inward from the sealing lip and towards the container side through the ring aperture. A circumferential connection is provided between the lid element and the ring element.

In the above configuration, a ring chamber is formed between the ring element and the lid element. The ring chamber is sealed by the sealing contact in the sealing configuration. A non-sealing configuration is temporarily achievable by reversibly deforming the sealing lip. In order to allow a reversable deformation, the sealing lip and the lip element are flexible, whereas the ring element is more rigid than the lip element as explained herein-below.

At least one channel is formed in the lid element and extends from a respective container side channel inlet outside the ring chamber to a respective channel outlet in the ring chamber.

The lid element forms a liquid impermeable barrier between the container side and the cover side of the container closure. When the container closure is attached to a container opening, the ring chamber is in fluid communication with the inside of the container. By deforming the sealing lip with the users mouth, i.e. applying deforming forces by sucking in particular, the sealing contact is interrupted and liquid can be drunk from the container, if the container with the container closure is tilted at the same time. Accordingly, a temporary liquid path can be established from the inside of the container through at least one channel, the ring chamber and the gap between the deformed sealing lip and the sealing surface of the ring element.

As explained above, the sealing lip is more flexible than at least the part of the ring element forming the sealing surface, and at least the part of the ring element forming the sealing surface is more rigid than the sealing lip. At least a part of the lid element next to the sealing lip is advantageously also more flexible than at least the part of the ring element forming the sealing surface.

This can be advantageously achieved, according to one embodiment, in that the first circumferential sealing surface, and preferably the ring element for the most part, is formed of a first material having a first modulus of elasticity, and the sealing lip, and preferably at least part of the lid element as well, is formed of a second material having a second modulus of elasticity smaller than said first modulus of elasticity.

Preferably, the first modulus of elasticity amounts to at least twice, preferably at least four times and particularly preferred at least eight times the second modulus of elasticity.

According to a particularly preferred embodiment the first material is a plastic material and the second material is an elastomer material. For example, the first material may be a thermoplastic material such as polypropylene, polyethylene, polyamide or the like, or a resin material such as polycarbonate. The second material may advantageously be, for example, a rubber material, butadiene rubber or other synthetic rubber or a flexible silicone material, wherein the latter is particularly preferred in many cases of application.

Both the ring element and the lid element including the sealing lip may be manufactured using production methods per se known from the prior art. Suitable production methods include but are not limited to injection molding, extrusion, vacuum molding etc.

According to a particularly preferred embodiment, the lid element can have an indention at its cover side providing some space for the user's nose when tilting the container to which the container closure is fixed for drinking. Therein, the maximum depth of the indentation relative to the outermost cover side part of the lid element is preferably at least two centimeters, more preferably at least three centimeters.

Advantageously, the circumferential connection may comprise at least one circumferential recess and at least one circumferential protrusion engaging therewith, such that either of the protrusion or the recess is provided lid element side and the respective other of protrusion and recess is provided ring element side.

According to another advantageous embodiment, the ring element and the lid element are non-destructively separable from each other at the circumferential connection, and the container can be re-assembled after separation, preferably without requiring the use of tools for either of separating and reassembling. Therein, separating the lid element from the ring element may facilitate cleaning considerably.

Further, the lid element may be advantageously selected from a kit of several lid elements having mutually different designs such as in color, material properties or structure. In other words, different interchangeable lid elements may advantageously be provided. For example, lid elements of mutually different flexibility (or stiffness), or lid elements with respective sealing lips of mutually different flexibility (or stiffness), may be advantageously provided, wherein more flexible lid elements/sealing lips require less force applied by sucking for drinking, whereas stiffer lid elements/sealing lips may provide a tighter sealing contact. Also for example lid elements with a mutual different size and/or number of channels may advantageously be provided.

Advantageously, the ring element may comprise container fixing means for fixing the ring element to a container in a manner of the container closure covering the container opening. Preferably, the fixing means comprise a thread for being connected to a matching container thread. However, other fixing mechanisms such as a snap mechanism may also constitute advantageous alternatives.

According to a further advantageous embodiment, the ring element may be connected to or integrally formed with at least one handle in order to improve gripping in particularly for users with motor impairments or clumsy children. Therein, the handle or handles may have any shape facilitating gripping, for example plates with handholes, a ring shape, an open ring shape, a contoured bar shape or the like. Further, the handle or handles may be coated with or made of a material more comfortable to grip, for example the handle or handles may comprise a soft silicone material coating, chloroprene coating or be made of a hard rubber or synthetic rubber material.

In an enhancement thereof, the handle or handles may be non-destructively separable from the ring element and re-attachable thereto, preferably without requiring the use of tools for either of separating and re-attaching. For example, the handle or handles may be formed integrally with or attached to an auxiliary ring element engageable with the ring element.

Depending on the intended application, the number, shape and arrangement of the at least one channel may be different.

According to a particularly advantageous embodiment, the container closure comprises at least three channels formed in the lid element, evenly distributed in a circumferential direction of said lid element, and each extending from a respective container side channel inlet outside the ring chamber to a respective channel outlet in the ring chamber.

This allows the user to drink from the container attached to the container closure regardless of the circumferential position of the mouth at the sealing lip. To further facilitate drinking regardless of the circumferential position, a number of five or six channels has proven to be advantageous in many cases. However, a number of three channels may already be sufficient to allow drinking from any circumferential position of the mouth at the sealing lip.

In certain alternative embodiments when it is not desirable to allow drinking from any circumferential position of the mouth relative to the container attached to the container closure, it may be even advantageous to reduce the number of channels. One advantageous variation, for example, provides two channels of mutually different sizes at opposite directions (opposite relative to a plane that includes the central axis of the container attached to the container closure) in order to have one side with a channel allowing little liquid throughputs for drinking small portions and one side with a channel allowing higher liquid throughputs for drinking larger portions. Such an arrangement can be advantageous in sports or outdoor settings. Therein, the directions for high and low throughputs may be marked by different colors, surface structures or the like.

According to a particularly preferred embodiment of the present invention, the respective channel inlet and the respective channel outlet may jointly form a continuous container side channel opening interrupting the circumferential connection. Open channels may facilitate production of the lid element. Further, open channels can be particularly advantageous in order to prevent clogging thereof and in order to facilitate cleaning or sterilizing.

Nevertheless, it is also advantageously possible to provide channels in the form of bores in the lid element.

According to another preferred embodiment, a detachable cover is provided at the cover side of the container closure. Therein the cover is non-destructively separable from the container closure and re-attachable thereto, preferably without requiring the use of tools for either of separating and re-attaching. Therein the cover may serve to protect the lid element from getting dusty or from other kinds of contamination and may further mechanically protect the sealing lip.

The invention also provides, according to another aspect thereof, a container arrangement comprising a container and a container closure as described above.

Therein, the container may be of any kind per se known from the prior art, i.e. cup shaped or bottle shaped, for example, in particular having a shape resembling a baby bottle.

The container may be of any suitable material, opaque, transparent or semi-transparent, such as polycarbonate, acrylic or other synthetic material, glass, ceramics or metal, e.g. aluminum.

The invention further provides, according to yet another aspect thereof, a lid element for use in a container closure as described above.

According to one aspect in particular, the lid element is tapered to have an indented cover side and a bulged container side and forms a liquid impermeable barrier between the cover side and the container side. The maximum depth of the indentation relative to the outermost cover side part of the lid element is at least two centimeters, preferably at least three centimeters.

The lid element is formed of an elastomer material such as an elastic silicone material, rubber material or synthetic rubber.

The lid element comprises a circumferential sealing lip forming the outer edge of the lid element and a connection element for engaging with a mating counterpart, wherein the connection element comprises at least one of a circumferential groove or a circumferential protrusion and is arranged on the container side of said lid element at a position between said sealing lip and the outermost container side part of the lid element. The lid element further comprises at least one channel extending from a respective container side channel inlet located closer to the outermost container side part of the lid element than the connection element to a respective channel outlet located closer to the sealing lip than the connection element.

Advantageous variations of the lid element can be implemented as described above in connection with the container closure.

Hereinafter, examples of preferred embodiments of the present invention will be described in more detail with reference to the accompanying drawings, to which the invention is not limited, however. Generally, any embodiment of the invention described or suggested in the context of the present application may be particularly advantageous, depending on economic circumstances and/or technical conditions in any specific case of intended use. Unless stated otherwise, or as far as technically feasible, individual features of all embodiments described herein are interchangeable or may be combined with one another and with features known per se from the prior art.

The drawing are purely schematic and, for the sake of clarity, not necessarily to scale, though geometric proportions may be similar in certain implementations depending on intended use. In particular, ratios between dimensions, especially diameters, strengths of wall parts etc. may differ. In practice, dimensions may be selected according to the requirements of the individual case or according to the dimensions of common standard parts.

It will of course be appreciated that features described in relation to one aspect of the present disclosure described above may be incorporated into other aspects of the present disclosure.

DESCRIPTION OF THE DRAWINGS

FIG. 2*a* shows a front view of the container arrangement depicted in FIG. 1, yet without the cover, FIG. 2*b* shows a sectional view of the container arrangement depicted in FIG. 2*a* wherein the sectional plane is indicated in FIG. 2*a* as broken line A-A and the arrows in FIG. 2*a* indicate the viewing direction of FIG. 2*b*, FIG. 2*c* shows, at a smaller scale, a side view of the container arrangement depicted in FIGS. 2*a* and 2*b* with the identical viewing direction as in FIG. 2*b*, FIG. 2*d* shows, at the same scale as FIG. 2*c*, a top view of the container arrangement depicted in FIGS. 2*a*-2*c*, FIG. 2*e* shows, at the same scale as FIGS. 2*c* and 2*d*, a bottom view of the container arrangement depicted in FIGS. 2*a*-2*d*, FIG. 2*f* shows a perspective view of the container arrangement depicted in FIGS. 2*a*-2*e* from diagonally above, FIG. 3*a* shows a perspective view, from diagonally above, of a lid element according to an embodiment of the present invention and identical with the lid element of the container arrangement depicted in FIGS. 1-2*f*, FIG. 3*b* shows a perspective view, from diagonally below, of the lid element depicted in FIG. 3*a*, FIG. 3*c* shows a side view of the lid element depicted in FIGS. 3*a* and 3*b*, FIG. 3*d* shows a top view of the lid element depicted in FIGS. 3*a*-3*c*, and FIG. 3*e* shows a bottom view of the lid element depicted in FIGS. 3*a*-3*d*.

DETAILED DESCRIPTION

Figure 1:
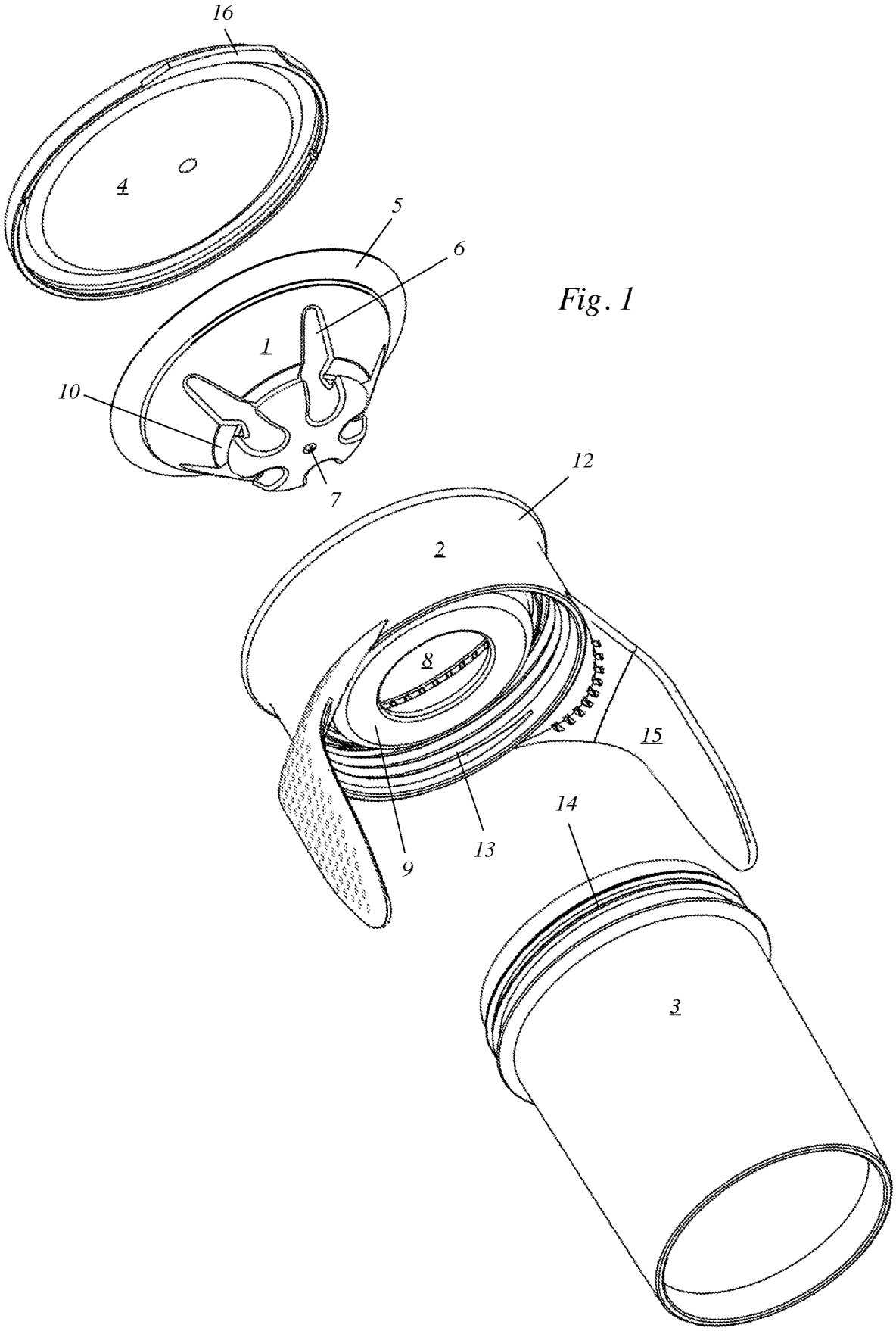
FIG. 1 shows a perspective exploded view of a container arrangement according to an embodiment of the present invention comprising a container, a threaded ring element, a lid element and a cover, the lid element and the ring element together constituting an embodiment of a container closure according to the present invention.

In the drawings, corresponding elements are marked with the same respective reference numerals. In the language of the claims, a top view corresponds to a view from (and onto) the cover side, and a bottom view corresponds to a view from (and onto) the container side.

For correctly interpreting FIGS. 2*d*, 2*f*, 3*b* and 3*d* it is to be understood that the lid element 1 is made from a transparent or semi-transparent material making the channels 6 visible from above (cover side) though the channels 6 are only open towards below (container side) and the lid element 1 thus constitutes a liquid impermeable barrier between the cover side and the container side.

The arrangement shown, as an exploded view, in FIG. 1 comprises the lid element 1 and the ring element 2, together constituting a container closure. The arrangement further comprises the container 3 and the cover 4.

The lid element 1 according to the exemplary embodiment of the invention is tapered and extends from the circumferential sealing lip 5 inward and downward to the lowest part 7 (outermost container side part) of the lid element 1. In the present embodiment, the sealing lip 5 is formed integral with the lid element 1.

As best seen in FIGS. 3*a* and 3*b* in connection with FIG. 1, the lid element 1 is indented on its cover side (top) and bulged on its container side (bottom). As best seen in FIG. 2*b* in connection with FIG. 1, the lid element 1 extends through the ring aperture 8 of the ring element 2. Therein, the skirt 9 of the ring element 2 protruding inward towards and delimiting the ring aperture 8 functions as a mating counterpart for the circumferential groove 10 of the lid element 1 and engages therewith to form a circumferential connection between the ring element 2 and lid element 1. The skirt 9 and groove 10 thus cooperate to keep the ring element 2 and lid element 1 in an axially fixed position relative to each other.

As illustrated in FIG. 2*b*, a ring chamber 11 is formed between the ring element 2 (at the cover side thereof) and the lid element 1 (at the container side thereof). Through the channels 6 the ring chamber 11 is in fluid communication with the inside of the container 3. In the present embodiment, the channels 6 are entirely open towards the container side crossing (or interrupting) the circumferential groove 10. In the region between the groove 10 and the lowest part 7 of the lid element 1 the channel opening forms a channel inlet to let liquid in from the inside of the container 3. In the region between the groove 10 and the sealing lip 5 the channel opening forms a channel outlet to let liquid out into the ring chamber 11.

The upper (cover side) circumferential rim 12 forms a sealing surface matching a corresponding container side sealing surface of the sealing lip 5 and cooperates therewith to form a sealing contact between the ring element 2 and the lid element 1 in a sealing configuration as illustrated in FIG. 2*b*. To achieve the sealing arrangement, the sealing lip 5 is biased against the rim 12 due to longitudinal deformation of the flexible lid element 1 resulting from holding the lid element 1 in an appropriate longitudinal position relative to the ring element 2 by the connection between the skirt 9 and the groove 10. Therein ring element 2 is essentially rigid whereas the lid element 1 including the sealing lip 5 is substantially flexible, this means the modulus of elasticity (Young's modulus) of the plastic material forming the ring element 2 is, in the present embodiment, at least eight times higher than the modulus of elasticity of the rubber or silicone material forming the lid element.

Accordingly, in the sealing configuration, the ring chamber 11 is sealed towards the outside by the circumferential sealing contact between the sealing surfaces of the sealing lip 5 of the lid element 1 and the rim 12 of the ring element 2. Through the channels 6, on the other hand, the ring chamber 11 is in fluid communication with the container 3, as explained above. By deforming the sealing lip 5, which is possible due to the elasticity of the lid element 1 including the sealing lip 5, the sealing contact is interrupted and liquid can be drunk, if the container arrangement is tilted at the same time. Appropriate deforming forces can be applied by sucking, when the mouth is put over the brim formed by the rim 12 and the sealing lip 5. Therein, also due to elasticity of the lid material, the deformation is reversible and the sealing configuration will be automatically re-established by the restoring force of the deformed lid element 1/sealing lip 5, as soon as the deforming forces are sufficiently reduced.

As can be taken from FIGS. 2*d*, 3*d* and 3*e*, the five channels 6 are evenly distributed in a circumferential direction over the lid element 1. This allows to drink from the container arrangement regardless of the circumferential position of the mouth on the brim formed by the rim 12 and the sealing lip 5. To facilitate drinking regardless of the circumferential position, a number of five or six channels 6 has proven to be ideal in many cases. However, a number of three channels 6 may already be sufficient to allow drinking from any circumferential position of the mouth on the brim.

As a side note, there may by cases of application when it is not desirable to allow drinking from any circumferential position of the mouth relative to the container 3. In such cases, the number of channels 6 can be reduced, for example only one or two channels 6 may be provided. Other advantageous variations are possible, for example providing two channels of mutually different sizes at opposite directions (opposite relative to a plane that includes the central axis of the container arrangement) in order to have one side with a channel allowing little liquid throughputs for drinking small portions and one side with a channel allowing higher liquid throughputs for drinking larger portions. Such an arrangement can be advantageous in sports or outdoor settings.

Also as a side note, channels do not have to be open channels 6 as depicted in the drawings. It is also possible to provide channels in the form of bores in the lid element 1. However, in many cases open channels 6 as depicted in the drawings facilitate production of the lid element 1, prevent clogging of the channels 6 and facilitate cleaning.

In order to allow sufficient tilting without the nose of the user getting in the way, the depth of the cover side indentation of the lid element 1—that is, in the present embodiment, the distance between the plane spanned by the outermost cover-side part of the lid element 1 (imaginable as a flat sheet put on top of the lid element 1) and the cover side bottom of the indentation, i.e. the point where the longitudinal axis of the container arrangement crosses the cover side surface of the lid element in the present embodiment—has a suitable dimension, such as at least two or three centimeters.

The ring element 2 can be fixed to the opening of the container 3 by the inner thread 13 of the ring element 2 and the matching outer thread 14 of the container 3. The container 3 is made from a suitable resin such as polycarbonate but may also be made from other materials such as glass or aluminum.

In order to improve handling of the container arrangement, in particular to facilitate gripping the container arrangement, the ring element 2 is formed integral with (or may have attached thereto) two handles 15 extending radially outward and downward (i.e. towards the container side) from the ring element 2.

In order to protect the lid element 1 from getting dusty or from other kinds of contamination and in order to mechanically protect the sealing lip 5, the cover 4 can be removably attached to the cover side of the container closure constituted by the ring element 2 and the lid element 1. The integrated flap 16 facilitates removing the cover 4 without using finger nails thus protecting the sealing lip 5 from damage and contamination.

What is claimed is:

1. A container closure having a container side and a cover side and comprising:

a ring element which comprises a ring aperture and a first circumferential sealing surface;

a lid element circumferentially connected with and extending inward from a circumferential sealing lip and towards said container side through said ring aperture said lid element being formed of an elastomer material and being tapered to have an indented cover side and a bulged container side, said circumferential sealing lip forming the outer edge of said lid element and comprising a second circumferential sealing surface matching said first circumferential sealing surface to form together therewith, in a sealing configuration, a circumferential sealing contact;

a circumferential connection between said lid element and said ring element, said connection comprising a circumferential groove and a circumferential skirt and being arranged on the container side of said lid element at a position between said circumferential sealing lip and the outermost container side part of the lid element;

a ring chamber formed between said ring element and said lid element and sealed by said sealing contact in the sealing configuration; and at least one channel formed in said lid element and extending from a respective container side channel inlet outside said ring chamber to a respective channel outlet in said ring chamber, wherein said container side channel inlet is located closer to the outermost container side part of the lid element than said connection and said channel outlet is located closer to the circumferential sealing lip than said connection, wherein said lid element forms a liquid impermeable barrier between the container side and the cover side, and wherein a non-sealing configuration is temporarily achievable by reversibly deforming said sealing lip.

2. The container closure according to claim 1, wherein said sealing lip is formed integral with said lid element.

3. The container closure according to claim 1, wherein:

said first circumferential sealing surface is formed of a first material having a first modulus of elasticity; and said sealing lip is formed of a second material having a second modulus of elasticity smaller than said first modulus of elasticity.

4. The container closure according to claim 3, wherein said first modulus of elasticity amounts to at least twice said second modulus of elasticity.

5. The container closure according to claim 3, wherein said first material is a plastic material and said second material is an elastomer material.

6. The container closure according to claim 1, wherein said lid element has an indention at the cover side, and wherein the maximum depth of the indentation relative to the outermost cover side part of the lid element is at least two centimeters.

7. The container closure according to claim 1, wherein said ring element comprises container fixing means for fixing the ring element to a container.

8. The container closure according to claim 7, wherein said fixing means comprise a thread for being connected to a matching container thread.

9. The container closure according to claim 1, wherein said ring element is connected to or integrally formed with a handle.

10. The container closure according to claim 1 comprising at least three channels formed in said lid element, evenly distributed in a circumferential direction of said lid element, and each extending from the respective container side channel inlet outside said ring chamber to the respective channel outlet in said ring chamber.

11. The container closure according to claim 1, further comprising a detachable cover at the cover side of the container closure.

12. A container arrangement comprising a container and a container closure according to claim 1.

13. A lid element used in a container closure according to claim 1, said lid element forming a liquid impermeable barrier between the cover side and the container side, wherein the maximum depth of the indentation relative to the outermost cover side part of the lid element is at least two centimeters, and wherein said lid element comprises:

a circumferential sealing lip forming an outer edge of said lid element.

14. Lid element according to claim 13, wherein said respective channel inlet and said respective channel outlet jointly form a continuous container side channel opening interrupting at least one of the circumferential skirt or circumferential groove.

* * * * *